US009362032B2

(12) United States Patent
Arita et al.

(10) Patent No.: US 9,362,032 B2
(45) Date of Patent: Jun. 7, 2016

(54) HIGH-STRENGTH NON-ORIENTED ELECTRICAL STEEL SHEET

(75) Inventors: Yoshihiro Arita, Tokyo (JP); Masahiro Fujikura, Tokyo (JP); Hidekuni Murakami, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 14 days.

(21) Appl. No.: 14/111,245

(22) PCT Filed: Apr. 11, 2012

(86) PCT No.: PCT/JP2012/059886

§ 371 (c)(1),
(2), (4) Date: Oct. 11, 2013

(87) PCT Pub. No.: WO2012/141206

PCT Pub. Date: Oct. 18, 2012

(65) Prior Publication Data

US 2014/0030135 A1 Jan. 30, 2014

(30) Foreign Application Priority Data

Apr. 13, 2011 (JP) ..... 2011-089529

(51) Int. Cl.

| | |
|---|---|
| ***C22C 38/02*** | (2006.01) |
| ***C22C 38/04*** | (2006.01) |
| ***H01F 1/01*** | (2006.01) |
| ***C22C 38/06*** | (2006.01) |
| ***C22C 38/16*** | (2006.01) |
| ***H01F 1/16*** | (2006.01) |
| ***C22C 38/00*** | (2006.01) |
| *C21D 8/12* | (2006.01) |

(52) U.S. Cl.

CPC *H01F 1/01* (2013.01); *C22C 38/00* (2013.01); *C22C 38/02* (2013.01); *C22C 38/04* (2013.01); *C22C 38/06* (2013.01); *C22C 38/16* (2013.01); *H01F 1/16* (2013.01); *C21D 8/1222* (2013.01); *C21D 8/1233* (2013.01); *C21D 8/1261* (2013.01); *C21D 8/1272* (2013.01)

(58) Field of Classification Search

CPC ..... C22C 38/02; C22C 38/04; C22C 38/06; C22C 38/16

USPC ..... 420/91, 92, 93, 90, 89, 83, 84

See application file for complete search history.

(56) References Cited

U.S. PATENT DOCUMENTS

| | | | | |
|---|---|---|---|---|
| 5,803,989 | A * | 9/1998 | Kawamata et al. | 148/120 |
| 7,608,154 | B2 | 10/2009 | O-Hashi et al. | |
| 8,097,094 | B2 | 1/2012 | Murakami | |
| 2011/0056592 | A1 | 3/2011 | Arita et al. | |

FOREIGN PATENT DOCUMENTS

| | | | | |
|---|---|---|---|---|
| EP | 1679386 | | 7/2006 | |
| JP | 62-256917 | | 11/1987 | |
| JP | 06-330255 | | 11/1994 | |
| JP | 10-018005 | | 1/1998 | |
| JP | 11293338 | | 10/1999 | |
| JP | 2004002954 | A * | 1/2004 | C22C 38/00 |
| JP | 2004-084053 | | 3/2004 | |
| JP | 2005-344156 | | 12/2005 | |
| JP | 2006-118039 | | 5/2006 | |
| JP | 2007-031754 | | 2/2007 | |
| JP | 2008031490 | A * | 2/2008 | |
| JP | 2008-174773 | | 7/2008 | |
| JP | 2010-024509 | | 2/2010 | |
| JP | 2010121150 | | 6/2010 | |
| WO | 2005/033349 | | 4/2005 | |
| WO | 2007063581 | | 6/2007 | |
| WO | 2009/128428 | | 10/2009 | |

OTHER PUBLICATIONS

International Preliminary Report on Patentability dated Nov. 7, 2013 issued in corresponding PCT Application No. PCT/JP2012/059886.
International Search Report dated Jul. 17, 2012, issued in corresponding PCT Application No. PCT/JP2012/059886 [With English Translation].
Extended European Search Report dated Jan. 7, 2015 issued in corresponding EPC Application No. 12771871.6

* cited by examiner

*Primary Examiner* — Rebecca Lee
(74) *Attorney, Agent, or Firm* — Kenyon & Kenyon LLP

(57) ABSTRACT

A high-strength non-oriented electrical steel sheet contains: in mass %, C: 0.010% or less; Si: not less than 2.0% nor more than 4.0%; Mn: not less than 0.05% nor more than 0.50%; Al: not less than 0.2% nor more than 3.0%; N: 0.005% or less; S: not less than 0.005% nor more than 0.030%; and Cu: not less than 0.5% nor more than 3.0%, a balance being composed of Fe and inevitable impurities. An expression (1) is established where a Mn content is represented as [Mn] and a S content is represented as [S], and not less than $1.0\times10^4$ pieces nor more than $1.0\times10^6$ pieces of sulfide having a circle-equivalent diameter of not less than 0.1 μm nor more than 1.0 μm are contained per 1 $mm^2$ $$10\leq[Mn]/[S]\leq50 \quad (1).$$

4 Claims, No Drawings

HIGH-STRENGTH NON-ORIENTED ELECTRICAL STEEL SHEET

This application is a national stage application of International Application No. PCT/JP2012/059886, filed Apr. 11, 2012, which claims priority to Japanese Application No. 2011-089529, filed Apr. 13, 2011, the content of which is incorporated by reference in its entirety.

TECHNICAL FIELD

The present invention relates to a high-strength non-oriented electrical steel sheet suitable for an iron core material of an electrical apparatus.

BACKGROUND ART

In recent years, higher performance properties have been required for a non-oriented electrical steel sheet to be used as an iron core material of a rotary machine due to a worldwide increase in achievement of energy saving of an electrical apparatus. Recently in particular, as a motor to be used for an electric vehicle or the like, a demand for a small-sized high-power motor has been high. Such an electric vehicle motor has been designed to make high-speed rotation possible to thereby obtain high torque.

A high-speed rotation motor has also been used for a machine tool and an electrical apparatus such as a vacuum cleaner. The outer shape of a high-speed rotation motor for an electric vehicle is larger than that of a high-speed rotation motor for an electrical apparatus. Further, as a high-speed rotation motor for an electric vehicle, a DC brushless motor has been mainly used. In a DC brushless motor, magnets are embedded in the vicinity of an outer periphery of a rotor. In the above structure, the width of a bridge portion in an outer periphery portion of the rotor (the width between magnets from the most outer periphery of the rotor to a steel sheet) is extremely narrow, which is 1 to 2 mm, depending on a place. Therefore, a high-strength steel sheet has been required for a high-speed rotation motor for an electric vehicle rather than a conventional non-oriented electrical steel sheet.

A non-oriented electrical steel sheet is disclosed in which Mn and Ni are added to Si to achieve solid solution strengthening in Patent Literature 1. However, it is not possible to obtain sufficient strength even by the non-oriented electrical steel sheet. Further, due to the addition of Mn and Ni, its toughness is likely to be reduced, and sufficient productivity and a sufficient yield cannot be obtained. Further, the prices of alloys to be added are high. In recent years in particular, the price of Ni has suddenly risen due to a worldwide demand balance.

Non-oriented electrical steel sheets are disclosed in which carbonitride is dispersed in a steel to achieve strengthening in Patent Literatures 2 and 3. However, it is not possible to obtain sufficient strength even by the non-oriented electrical steel sheets.

A non-oriented electrical steel sheet is disclosed in which Cu precipitates are used to achieve strengthening in Patent Literature 4. However, it is difficult to obtain sufficient strength. For obtaining sufficient strength, annealing at high temperature is required to be performed in order to once solid-dissolve Cu. However, when the annealing at high temperature is performed, crystal grains coarsen. That is, even though precipitation strengthening by Cu precipitates is obtained, by the coarsening of crystal grains, strength decreases and thus sufficient strength cannot be obtained.

Further, due to the synergistic effect of precipitation strengthening and coarsening of crystal grains, fracture elongation significantly decreases.

A non-oriented electrical steel sheet is disclosed in which suppression of the coarsening of crystal grains in Patent Literature 4 is intended in Patent Literature 5. In the technique, C, Nb, Zr, Ti, V, and so are contained. However, at 150° C. to 200° C., being a heat generation temperature range of a motor, carbide precipitates finely and magnetic aging is likely to occur.

A non-oriented electrical steel sheet is disclosed in which by precipitates of Al and N, achievement of making crystal grains fine and precipitation strengthening by Cu is intended in Patent Literature 6. However, Al is contained in large amounts and thus it is difficult to sufficiently suppress the growth of crystal grains. Further, when an N content is increased, a cast defect is likely to occur.

A non-oriented electrical steel sheet containing Cu is disclosed in Patent Literature 7. However, in the technique, a heat treatment for a long period of time, and so on are performed, to thereby make it difficult to obtain good fracture elongation and so on.

CITATION LIST

Patent Literature

Patent Literature 1: Japanese Laid-open Patent Publication No. 62-256917

Patent literature 2: Japanese Laid-open Patent Publication No. 06-330255

Patent literature 3: Japanese Laid-open Patent Publication No. 10-18005

Patent literature 4: Japanese Laid-open Patent Publication No. 2004-84053

Patent literature 5: International Publication Pamphlet No. WO2009/128428

Patent literature 6: Japanese Laid-open Patent Publication No. 2010-24509

Patent literature 7: International Publication Pamphlet No. WO2005/33349

SUMMARY OF INVENTION

Technical Problem

The present invention has an object to provide a high-strength non-oriented electrical steel sheet allowing excellent strength and fracture elongation to be obtained while a good magnetic property being obtained.

Solution to Problem

The present invention has been made in order to solve the above-described problems, and the gist thereof is as follows.

(1) A high-strength non-oriented electrical steel sheet contains:

in mass %,

C: 0.010% or less;

Si: not less than 2.0% nor more than 4.0%;

Mn: not less than 0.05% nor more than 0.50%;

Al: not less than 0.2% nor more than 3.0%;

N: 0.005% or less;

S: not less than 0.005% nor more than 0.030%; and

Cu: not less than 0.5% nor more than 3.0%, a balance being composed of Fe and inevitable impurities, an expression (1) being established where a Mn content is represented as [Mn] and a S content is represented as [S], and not less than $1.0\times10^4$ pieces nor more than $1.0\times10^6$ pieces of sulfide having a circle-equivalent diameter of not less than 0.1 μm nor more than 1.0 μm being contained per 1 $mm^2$, $$10\leq[Mn]/[S]\leq50 \quad (1).$$

(2) The high-strength non-oriented electrical steel sheet according to (1) further contains, in mass %, Ni: not less than 0.5% nor more than 3.0%.

(3) The high-strength non-oriented electrical steel sheet according to (1) or (2) further contains, in mass %, 0.5% or less of one or more of Ti, Nb, V, Zr, B, Bi, Mo, W, Sn, Sb, Mg, Ca, Ce, Co, Cr, and REM in total.

Advantageous Effects of Invention

According to the present invention, the interaction of Cu precipitates and sulfide makes it possible to obtain excellent strength and fracture elongation while obtaining a good magnetic property.

DESCRIPTION OF EMBODIMENTS

The present inventors earnestly examined the technique of finely keeping crystal grains even if annealing is performed at a high temperature from a viewpoint different from that of Patent Literatures 5 and 6. As a result, it was found that the relationship between a S content and a Mn content is made appropriate and a content of sulfide having a predetermined size is made appropriate, thereby making it possible to finely keep crystal grains even if annealing is performed at a high temperature. In this case, an element which causes magnetic aging is not needed.

Here, there will be explained an experiment leading to the present invention. Hereinafter, "%" being the unit of a content means "mass %."

In the experiment, first, steels each containing C: 0.002%, Si: 3.2%, Mn: 0.20%, Al: 0.7%, N: 0.002%, and Cu: 1.5%, and further S having a content listed in Table 1, in which a balance is composed of Fe and inevitable impurities, were melted in a vacuum melting furnace in a laboratory, and a steel billet (slab) was made from each of the steels. In Table 1, [Mn] represents a Mn content (0.20%) and [S] represents a S content. Then, each of the steel billets was heated at 1100° C. for 60 minutes and was subjected to hot rolling immediately, whereby hot-rolled sheets each having a thickness of 2.0 mm were obtained. Thereafter, each of the hot-rolled sheets was subjected to hot-rolled sheet annealing at 1050° C. for one minute, pickling, and one time of cold rolling, whereby cold-rolled sheets each having a thickness of 0.35 mm were obtained. Subsequently, each of the cold-rolled sheets was subjected to finish annealing at 800° C. to 1000° C. for 30 seconds. The temperature of the finish annealing is listed in Table 1.

Then, a number density of sulfide in each of obtained non-oriented electrical steel sheets was measured. At this time, an object to be measured was one having a circle-equivalent diameter of not less than 0.1 μm nor more than 1.0 μm. Further, a yield stress, a fracture elongation, and a core loss were also measured. As the core loss, a core loss W10/400 was measured. Here, the core loss W10/400 is a core loss under the condition of frequency of 400 Hz and a maximum magnetic flux density of 1.0 T. These results are also listed in Table 1.

TABLE 1

| MATERIAL SYMBOL | S CONTENT (MASS %) | [Mn]/[S] | TEMPERATURE OF FINISH ANNEALING (° C.) | NUMBER DENSITY OF SULFIDE (PIECES/$mm^2$) | YIELD STRESS (MPa) | FRACTURE ELONGATION (%) | CORE LOSS W10/400 (W/kg) | VALUATION | REMARKS |
|---|---|---|---|---|---|---|---|---|---|
| A | 0.003 | 66.7 | 900 | $1.1\times10^3$ | 674 | 8 | 24.2 | POOR | LOW YIELD STRESS AND LOW FRACTURE ELONGATION |
| | | | 950 | $5.7\times10^2$ | 641 | 3 | 20.5 | POOR | LOW YIELD STRESS AND LOW FRACTURE ELONGATION |
| | | | 1000 | $8.6\times10$ | 605 | 1 | 19.6 | POOR | LOW YIELD STRESS AND LOW FRACTURE ELONGATION |
| B | 0.006 | 33.3 | 900 | $7.8\times10^4$ | 723 | 18 | 30.5 | GOOD | GOOD |
| | | | 950 | $1.2\times10^4$ | 728 | 15 | 27.6 | GOOD | GOOD |
| | | | 1000 | $5.8\times10^3$ | 713 | 9 | 25.6 | POOR | LOW FRACTURE ELONGATION |
| C | 0.008 | 25 | 900 | $3.2\times10^5$ | 768 | 22 | 31.8 | GOOD | GOOD |
| | | | 950 | $6.5\times10^4$ | 776 | 18 | 28.3 | GOOD | GOOD |
| | | | 1000 | $2.4\times10^4$ | 784 | 15 | 25.3 | GOOD | GOOD |
| D | 0.019 | 10.5 | 900 | $5.3\times10^5$ | 821 | 25 | 33.4 | GOOD | GOOD |
| | | | 950 | $1.2\times10^5$ | 845 | 22 | 30.1 | GOOD | GOOD |
| | | | 1000 | $6.6\times10^4$ | 875 | 19 | 29.3 | GOOD | GOOD |
| E | 0.025 | 8 | 900 | $6.7\times10^7$ | 834 | 8 | 55.7 | POOR | POOR CORE LOSS AND LOW FRACTURE ELONGATION |
| | | | 950 | $9.8\times10^6$ | 830 | 23 | 40.6 | POOR | POOR CORE LOSS |
| | | | 1000 | $2.4\times10^6$ | 815 | 25 | 39.6 | POOR | POOR CORE LOSS |

As listed in Table 1, in Material symbols B, C, and D each having the value of [Mn]/[S] being not less than 10 nor more than 50, a good property was obtained. However, even in Material symbol B, in the case where the finish annealing was performed at 1000° C., the number density of sulfide was low and the fracture elongation was low. On the whole, there is a tendency that, if the temperature of the finish annealing is increased, the number density of sulfide decreases even in the same material. This is conceivably because sulfide coarsens during the finish annealing. Then, when sulfide coarsens, the deterrent against the growth of crystal grains is weakened. This conception also applies to the result of the case when the finish annealing was performed at 1000° C. in Material symbol B. That is, it is conceivable that in the example, the temperature of the finish annealing was 1000° C., which was high, and thus sulfide coarsened, the number density of sulfide decreased, and the growth of crystal grains was not suppressed sufficiently.

On the other hand, in Material symbol A having the value of [Mn]/[S] being greater than 50, the fracture elongation was low and the yield stress was low. This is conceivably because [Mn]/[S] was high, and thus the number density of sulfide was low and the growth of crystal grains advanced.

Further, in Material symbol E having the value of [Mn]/[S] being less than 10, the core loss was high significantly. This is conceivably because [Mn]/[S] was low, and thus the number density of sulfide was high and the growth of crystal grains was suppressed significantly. Further, in the case where the temperature of the finish annealing was 900° C., the core loss was high and further the fracture elongation was low. This is conceivably because the number density of sulfide was extremely high, and thus not only the growth of crystal grains but also recrystallization was inhibited.

From the above experimental result, it is said that the S content, [Mn]/[S], and the number density of sulfide are each made to fall within a predetermined range, and thereby it is possible to obtain a high-strength non-oriented electrical steel sheet excellent in all the core loss, strength, and ductility. Such a property excellent in balance is a property that has not been obtained in a conventional steel sheet utilizing carbonitride, or steel sheet having only Cu added thereto simply.

Next, reasons for limiting the numerical values in the present invention will be explained.

C is effective for making crystal grains fine, but when a temperature of a non-oriented electrical steel sheet becomes 200° C. or so, C forms carbide to deteriorate a core loss. For example, when used for a high-speed rotation motor for an electric vehicle, a non-oriented electrical steel sheet is likely to reach this level of temperature. Then, when a C content is greater than 0.010%, such magnetic aging is significant. Thus, the C content is 0.010% or less, and is more preferably 0.005% or less.

Si is effective for a reduction in eddy current loss. Si is effective also for solid solution strengthening. However, when a Si content is less than 2.0%, these effects are insufficient. On the other hand, when the Si content is greater than 4.0%, cold rolling during manufacturing a non-oriented electrical steel sheet is likely to be difficult to be performed. Thus, the Si content is not less than 2.0% nor more than 4.0%.

Mn reacts with S to form sulfide. In the present invention, crystal grains are controlled by sulfide, so that Mn is an important element. When a Mn content is less than 0.05%, fixation of S is insufficient to cause hot shortness. On the other hand, when the Mn content is greater than 0.50%, it is difficult to sufficiently suppress growth of crystal grains. Thus, the Mn content is not less than 0.05% nor more than 0.50%.

Al is effective for a reduction in eddy current loss and solid solution strengthening, similarly to Si. Further, Al also exhibits an effect of causing nitride to coarsely precipitate to make nitride harmless. However, when an Al content is less than 0.2%, these effects are insufficient. On the other hand, when the Al content is greater than 3.0%, cold rolling during manufacturing a non-oriented electrical steel sheet is likely to be difficult to be performed. Thus, the Al content is not less than 0.2% nor more than 3.0%.

N forms nitride such as TiN to deteriorate a core loss. Particularly, in the case where a N content is greater than 0.005%, deterioration of a core loss is significant. Thus, the nitrogen content is 0.005% or less.

Cu improves strength through precipitation strengthening. However, when a Cu content is less than 0.5%, almost all the content of Cu is solid-dissolved and thus the effect of precipitation strengthening cannot be obtained. On the other hand, even when the Cu content is greater than 3.0%, the effect is saturated and an effect measuring up to the content cannot be obtained. Thus, the Cu content is not less than 0.5% nor more than 3.0%.

S reacts with Mn to form sulfide. In the present invention, crystal grains are controlled by sulfide, so that S is an important element. When a S content is less than 0.005%, the effect cannot be obtained sufficiently. On the other hand, even when the S content is greater than 0.030%, the effect is saturated and an effect measuring up to the content cannot be obtained. Further, as the S content is increased, hot shortness is more likely to occur. Thus, the S content is not less than 0.005% nor more than 0.030%.

In the present invention, [Mn]/[S] is an important parameter for obtaining a good yield stress, a good fracture elongation, and a good core loss. When [Mn]/[S] is greater than 50, the effect of suppressing growth of crystal grains is insufficient and a yield stress and a fracture elongation decrease. On the other hand, when [Mn]/[S] is less than 10, a fracture elongation decreases significantly and a core loss deteriorates significantly. Thus, [Mn]/[S] is not less than 10 nor more than 50. That is, an expression (1) is established where a Mn content is represented as [Mn] and a S content is represented as [S].

$$10 \leq [Mn]/[S] 50 \quad (1)$$

Ni is an effective element capable of achieving a high strength of a steel sheet without embrittling it so much. But, Ni is expensive and thus is preferably contained according to need. In the case of Ni being contained, for obtaining the sufficient effect, the content is preferably 0.5% or more and is preferably 3.0% or less in consideration of its cost. Further, Ni also has an effect of suppressing scabs caused by Cu being contained. For obtaining this effect, the Ni content is preferably ½ or more of a Cu content.

Further, Sn has an effect of improving a texture and suppressing nitridation and oxidation during annealing. Particularly, there is a significant effect of compensating a magnetic flux density, which is decreased due to Cu being contained, by improving the texture. For obtaining this effect, Sn may be contained to fall within a range of not less than 0.01% nor more than 0.10%.

Further, as for other trace elements, adding them because of various purposes in addition to their amount inevitably contained does not impair the effect of the present invention at all. Inevitable contents of these trace elements each are normally about 0.005% or less, but about 0.01% or more may be added for various purposes. Also in this case, it is possible to contain 0.5% or less of one or more of Ti, Nb, V, Zr, B, Bi, Mo, W, Sn, Sb, Mg, Ca, Ce, Co, Cr, and REM in total in view of the cost and magnetic property.

Next, the number density of sulfide will be explained. As is clear from the above-described experimental result, as for the number density of sulfide having a circle-equivalent diameter of not less than 0.1 μm nor more than 1.0 μm, an appropriate range exists in terms of a fracture elongation and a core loss.

When the above number density is less than $1.0\times10^4$ pieces/$mm^2$, sulfide is insufficient to thereby make it impossible to sufficiently suppress growth of crystal grains, and although a good core loss can be obtained, a fracture elongation decreases extremely. On the other hand, when the above number density is greater than $1.0\times10^6$ pieces/$mm^2$, growth of crystal grains is suppressed excessively and a core loss deteriorates extremely. Further, recrystallization is sometimes suppressed, and in this case, not only the core loss but also a fracture elongation deteriorates. Thus, the number density of sulfide having a circle-equivalent diameter of not less than 0.1 μm nor more than 1.0 μm is not less than $1.0\times10^4$ pieces/$mm^2$ nor more than $1.0\times10^6$ pieces/$mm^2$.

In the case when these conditions are satisfied, for example, a yield stress is likely to be 700 MPa or more, and a fracture elongation is likely to be 10% or more. Further, in the case when the preferable conditions are satisfied, the fracture elongation is likely to be 12% or more. Further, for example, a recrystallization area ratio is likely to be 50% or more, and when the thickness of a steel sheet is represented as t (mm), a core loss W10/400 is likely to be 100×t or less.

Next, there will be explained a manufacturing method of a high-strength non-oriented electrical steel sheet according to an embodiment of the present invention.

In the present embodiment, a slab having the above-described composition is first heated at 1150° C. to 1250° C. or so and is subjected to hot rolling, and thereby a hot-rolled sheet is made to then be coiled. Then, the hot-rolled sheet is subjected to cold rolling while being uncoiled, and thereby a cold-rolled sheet is made to then be coiled. Thereafter, finish annealing is performed. Then, an insulating film is formed on the front surface of a steel sheet obtained in this manner. That is, the manufacturing method according to the present embodiment is based on a substantially well-known manufacturing method of a non-oriented electrical steel sheet.

The condition of each treatment is not limited in particular, but preferable ranges exist as described below. For example, a finishing temperature of the hot rolling is preferably 1000° C. or higher and a coiling temperature is preferably 650° C. or lower, and both of the temperatures are preferably determined appropriately according to the contents of Mn, S, and Cu. This is to obtain the above-described number density of sulfide. If a finishing temperature is too low or a coiling temperature is too high, fine MnS sometimes precipitates excessively. In this case, there is sometimes a case that growth of crystal grains during the finish annealing is suppressed excessively to thereby make it impossible to obtain a good core loss.

A temperature of the finish annealing is preferably approximately 800° C. to 1100° C., and its period of time is preferably shorter than 600 seconds. Further, in the finish annealing, continuous annealing is preferably performed.

In terms of improving a magnetic flux density, hot-rolled sheet annealing is preferably performed before the cold rolling. Its condition is not limited in particular, but the hot-rolled sheet annealing is preferably performed in a range of 1000° C. to 1100° C. for 30 seconds or longer. The hot-rolled sheet annealing performed in the temperature range makes it possible to moderately grow MnS in the hot-rolled sheet and to decrease variation in the degree of MnS precipitation in the longitudinal direction. As a result, a property stable in the longitudinal direction can be obtained even after the finish annealing. When the temperature of the hot-rolled sheet annealing is lower than 1000° C., or its period of times is shorter than 30 seconds, these effects are small. On the other hand, when the temperature of the hot-rolled sheet annealing is greater than 1100° C., part of sulfide is solid-dissolved and a crystal grain diameter after the finish annealing is too fine, and thus a good core loss sometimes cannot be obtained.

EXAMPLE

Next, experiments conducted by the present inventors will be explained. The conditions and so on in these experiments are examples employed for confirming the applicability and effects of the present invention, and the present invention is not limited to these examples.

First, steels each containing Si: 3.3%, Mn: 0.10%, Al: 0.8%, N: 0.002%, and Cu: 1.2%, and further Ni having a content listed in Table 2, and S having a content listed in Table 2, in which a balance is composed of Fe and inevitable impurities, were melted in a vacuum melting furnace in a laboratory, and a steel billet (slab) was made from each of the steels. Then, each of the steel billets was heated at 1100° C. for 60 minutes and was subjected to hot rolling immediately, whereby hot-rolled sheets each having thickness of 2.0 mm were obtained. Thereafter, each of the hot-rolled sheets was subjected to hot-rolled sheet annealing at 1020° C. for 60 seconds, pickling, and one time of cold rolling, whereby cold-rolled sheets each having a thickness of 0.30 mm were obtained. Subsequently, each of the cold-rolled sheets was subjected to finish annealing at 900° C. for 45 seconds.

Then, a number density of sulfide in each of obtained non-oriented electrical steel sheets was measured. At this time, an object to be measured was one having a circle-equivalent diameter of not less than 0.1 μm nor more than 1.0 μm. Further, a yield stress, a fracture elongation, and a core loss were also measured. As the core loss, a core loss W10/400 was measured. These results are also listed in Table 2.

TABLE 2

| MATRIAL SYMBOL | Ni CONTENT (MASS %) | S CONTENT (MASS %) | [Mn]/[S] | NUMBER DENSITY OF SULFIDE (PIECES/$mm^2$) | YIELD STRESS (MPa) | FRACTURE ELONGA-TION (%) | CORE LOSS W10/400 (W/kg) | VALUATION | REMARKS |
|---|---|---|---|---|---|---|---|---|---|
| a | 0.02 | 0.001 | 100 | $3.2\times10^2$ | 691 | 3 | 16.3 | POOR | COMPARATIVE EXAMPLE (LOW FRACTURE ELONGATION) |
| b | | 0.005 | 20 | $4.3\times10^4$ | 721 | 12 | 20.4 | GOOD | INVENTIVE EXAMPLE |
| c | | 0.007 | 14.3 | $2.5\times10^5$ | 746 | 15 | 23.5 | GOOD | INVENTIVE EXAMPLE |
| d | | 0.009 | 11.1 | $8.8\times10^5$ | 781 | 16 | 27.6 | GOOD | INVENTIVE EXAMPLE |
| e | | 0.012 | 8.3 | $1.5\times10^6$ | 811 | 6 | 30.6 | POOR | COMPARATIVE EXAMPLE (POOR CORE LOSS AND LOW FRACTURE ELONGATION) |
| f | 1 | 0.001 | 100 | $3.3\times10^2$ | 740 | 2 | 16.1 | POOR | COMPARATIVE EXAMPLE (LOW FRACTURE |

TABLE 2-continued

| MATRIAL SYMBOL | Ni CONTENT (MASS %) | S CONTENT (MASS %) | [Mn]/[S] | NUMBER DENSITY OF SULFIDE (PIECES/mm$^2$) | YIELD STRESS (MPa) | FRACTURE ELONGA-TION (%) | CORE LOSS W10/400 (W/kg) | VALUATION | REMARKS |
|---|---|---|---|---|---|---|---|---|---|
| | | | | | | | | | ELONGATION) |
| g | | 0.005 | 20 | $4.2 \times 10^4$ | 765 | 11 | 20.2 | EXCELLENT | INVENTIVE EXAMPLE (HIGH STRENGTH WITH Ni: 1%) |
| h | | 0.007 | 14.3 | $2.6 \times 10^5$ | 785 | 13 | 23.1 | EXCELLENT | INVENTIVE EXAMPLE (HIGH STRENGTH WITH Ni: 1%) |
| i | | 0.009 | 11.1 | $8.7 \times 10^5$ | 821 | 14 | 27.2 | EXCELLENT | INVENTIVE EXAMPLE (HIGH STRENGTH WITH Ni: 1%) |
| j | | 0.012 | 8.3 | $1.3 \times 10^6$ | 855 | 3 | 30.2 | POOR | COMPARATIVE EXAMPLE (POOR CORE LOSS AND LOW FRACTURE ELONGATION) |
| k | 2.5 | 0.001 | 100 | $3.1 \times 10^2$ | 791 | 3 | 16 | POOR | COMPARATIVE EXAMPLE (LOW FRACTURE ELONGATION) |
| l | | 0.005 | 20 | $4.1 \times 10^4$ | 816 | 13 | 20 | EXCELLENT | INVENTIVE EXAMPLE (FURTHER HIGH STRENGTH WITH Ni: 2%) |
| m | | 0.007 | 14.3 | $2.7 \times 10^5$ | 833 | 16 | 22.9 | EXCELLENT | INVENTIVE EXAMPLE (FURTHER HIGH STRENGTH WITH Ni: 2%) |
| n | | 0.009 | 11.1 | $8.3 \times 10^5$ | 877 | 17 | 27 | EXCELLENT | INVENTIVE EXAMPLE (FURTHER HIGH STRENGTH WITH Ni: 2%) |
| o | | 0.012 | 8.3 | $1.2 \times 10^6$ | 910 | 4 | 31.5 | POOR | COMPARATIVE EXAMPLE (POOR CORE LOSS AND LOW FRACTURE ELONGATION) |

As listed in Table 2, in Material symbols b, c, and d each having the value of [Mn]/[S] being not less than 10 nor more than 50 and the number density of sulfide being not less than $1.0\times10^4$ pieces nor more than $1.0\times10^6$ pieces, a good yield strength, a good fracture elongation, and a good core loss were obtained. Further, in Material symbols g, h, and i each having the Ni content of 1.0%, as compared with Material symbols b, c, and d each having the Ni content of 0.02% (containing substantially no Ni added thereto), an approximately equal fracture elongation and an approximately equal core loss were obtained, and further a high yield strength by about 50 MPa was obtained. In Material symbols 1, m, and n each having the Ni content of 2.5%, as compared with Material symbols b, c, and d each having the Ni content of 0.02% (containing substantially no Ni added thereto), an approximately equal fracture elongation and an approximately core loss were obtained, and further a high yield strength by about 100 MPa was obtained.

It should be noted that the above-described embodiment merely illustrates a concrete example of implementing the present invention, and the technical scope of the present invention is not to be construed in a restrictive manner by the embodiment. That is, the present invention may be implemented in various forms without departing from the technical spirit or main features thereof.

INDUSTRIAL APPLICABILITY

The present invention may be utilized in an industry of manufacturing electrical steel sheets and in an industry of utilizing electrical steel sheets such as motors.

The invention claimed is:

1. A high-strength non-oriented electrical steel sheet, containing:

in mass %,

C: 0.010% or less;

Si: not less than 2.0% nor more than 4.0%;

Mn: not less than 0.05% nor more than 0.50%;

Al: not less than 0.2% nor more than 3.0%;

N: 0.005% or less;

S: not less than 0.005% nor more than 0.030%; and

Cu: not less than 1.2% nor more than 3.0%, a balance being composed of Fe and inevitable impurities, an expression (1) being established where a Mn content is represented as [Mn] and a S content is represented as [S], not less than $2.5\times10^5$ pieces nor more than $1.0\times10^6$ pieces of sulfide having a circle-equivalent diameter of not less than 0.1 μm nor more than 1.0 μm being contained per 1 mm$^2$, and hot rolling having been performed at a finishing temperature of 1000° C. or higher and a coiling temperature of 650° C. or lower, $$10 \leq [Mn]/[S] \leq 50 \quad (1).$$

2. The high-strength non-oriented electrical steel sheet according to claim 1, further containing, in mass %, Ni: not less than 0.5% nor more than 3.0%.

3. The high-strength non-oriented electrical steel sheet according to claim 1, further containing, in mass %, 0.5% or less in total of at least one element selected from the group consisting of Ti, Nb, V, Zr, B, Bi, Mo, W, Sn, Sb, Mg, Ca, Ce, Co, Cr, and REM.

4. The high-strength non-oriented electrical steel sheet according to claim 2, further containing, in mass %, 0.5% or less in total of at least one element selected from the group consisting of Ti, Nb, V, Zr, B, Bi, Mo, W, Sn, Sb, Mg, Ca, Ce, Co, Cr, and REM.

* * * * *